United States Patent [19]

Paquet et al.

[11] Patent Number: 4,575,322

[45] Date of Patent: Mar. 11, 1986

[54] OIL-SEALED VANE PUMP

[75] Inventors: Jean-Marc Paquet; René Sibuet, both of Annecy, France

[73] Assignee: Compagnie Industrielle des Telecommunications Cit-Alcatel, Annecy, France

[21] Appl. No.: 675,390

[22] Filed: Nov. 28, 1984

[30] Foreign Application Priority Data

Nov. 30, 1983 [FR] France ..... 83 19148

[51] Int. Cl.[4] ..... F04C 27/02; F04C 29/02

[52] U.S. Cl. ..... 418/96; 418/97

[58] Field of Search ..... 418/96, 97-100; 137/312

[56] References Cited

U.S. PATENT DOCUMENTS 3,217,977 11/1965 Burger ..... 418/96

3,421,688 1/1969 Spooner ..... 418/96

FOREIGN PATENT DOCUMENTS 661031 6/1938 Fed. Rep. of Germany ..... 418/96

*Primary Examiner*—John J. Vrablik

*Attorney, Agent, or Firm*—Sughrue, Mion, Zinn, Macpeak, and Seas

[57] ABSTRACT

Oil-sealed vane pump has a stator and a rotor assembly housed in an oil-filled tank, said stator comprising an oil injection orifice, a suction port connected to a tank inlet pipe and a discharge port opening into said tank, said discharge port being provided with a check valve, said check valve being mounted in a spot facing in the stator and said tank further comprising a discharge outlet. The stator is provided with at least one slot opening into the spot facing.

2 Claims, 4 Drawing Figures

OIL-SEALED VANE PUMP

BACKGROUND OF THE INVENTION

This invention concerns an oil-sealed vane pump.

Such a pump basically comprises a stator consisting of a body comprising a cylindrical housing wherein a cylindrical rotor rotates eccentrically and tangentially to a generatrix of said housing. The rotor supports two diametrically opposed vanes applied by means of springs (as well as by centrifugal force) to the stator. A suction port and a discharge port respectively are provided on each side of the stator and rotor tangency generatrix. The discharge port is provided with a check valve. The seat of this valve consists of the bottom of a spot facing in the stator. The foregoing assembly is placed in an oil-filled tank. The suction port is connected to a tank inlet pipe and the discharge port leads to the inside of the tank which is itself provided with an outlet pipe.

Oil required for lubrication and sealing between the vanes and the stator as well as between the rotor and its line of tangency with the stator enters through an injection orifice in one of the side walls of the stator. This orifice is fitted with a cutoff valve made to alternately open and close in the course of pump operation by means of a rotary actuator mounted on the rotor shaft. This valve prevents oil entering the stator when the pump is stopped. However, in the event this actuator fails and the valve stays open when the pump is stopped, the stator fills with oil and on restarting the pump a large amount of oil is ejected through the discharge port. Since the flow passage between the valve, located at the discharge port, and the walls of the spot facing in which the valve is mounted is too small to allow such a large flow of oil to pass, such ejections result in damage to the valve and eventually to its spring, such as deformation or sticking.

The above-mentioned spot facing enables retention of a small amount of oil providing a seal between the valve and the stator when the pump is stopped.

SUMMARY OF THE INVENTION

The present invention is directed to obviating the abovementioned disadvantage by providing an oil-sealed vane pump comprising a stator and a rotor mounted in an oil-filled tank, said stator having an oil injection orifice, a suction port connected to a tank inlet pipe and a discharge port opening into the tank, said discharge port being provided with a check valve fitting into a spot facing in the stator, said tank further comprising a discharge port, said pump wherein at least one slot is provided in said stator such that said slot opens into said spot facing.

According to a preferred embodiment of the invention, said slot opens into said spot facing at a level slightly higher than the bottom of said spot facing.

According to another preferred embodiment, said slot begins at the periphery of the stator, goes through the spot facing and extends beyond the diametrically opposite wall of the spot facing.

An embodiment of the invention will now be described with reference to the accompanying drawings.

DETAILED DESCRIPTION OF THE PREFERRED EMBODIMENT

Figure 1:
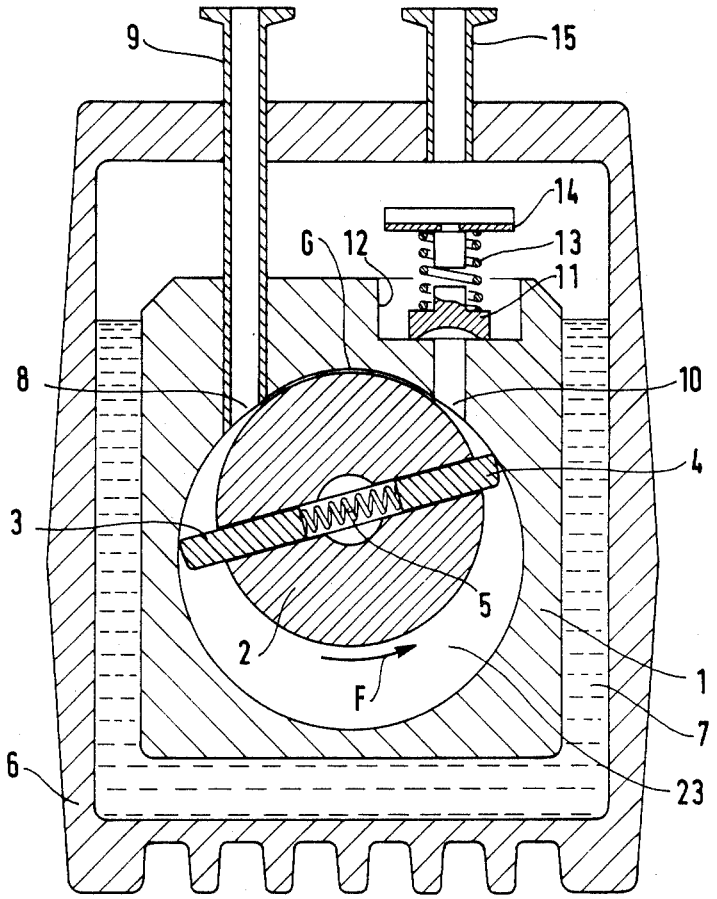
FIG.1 PRIOR ART
FIG. 1 is a sectional view, taken normally to the rotational axis, of an oil-sealed vane pump.

FIG. 1, depicting a well-known oil-sealed vane pump, shows a stator 1 and a rotor 2 off-centered such as to be tangent to a generatrix G of the stator. The rotor supports sliding vanes 3 and 4 which are actuated by springs 5 as well as by centrifugal force. This assembly is placed in a tank 6 filled with oil 7. The stator has a suction port 8 connected to a tank 6 inlet pipe 9; it is further provided with a discharge port 10 opening directly into the tank. Said discharge port 10 is provided with a check valve 11, the seat of which is located at the bottom of the spot facing 12 due to the action of a spring 13, said spring also pushing off of a valve cover 14 attached to the side panels of the stator. The tank 6 is also provided with a discharge outlet 15.

Figure 2:
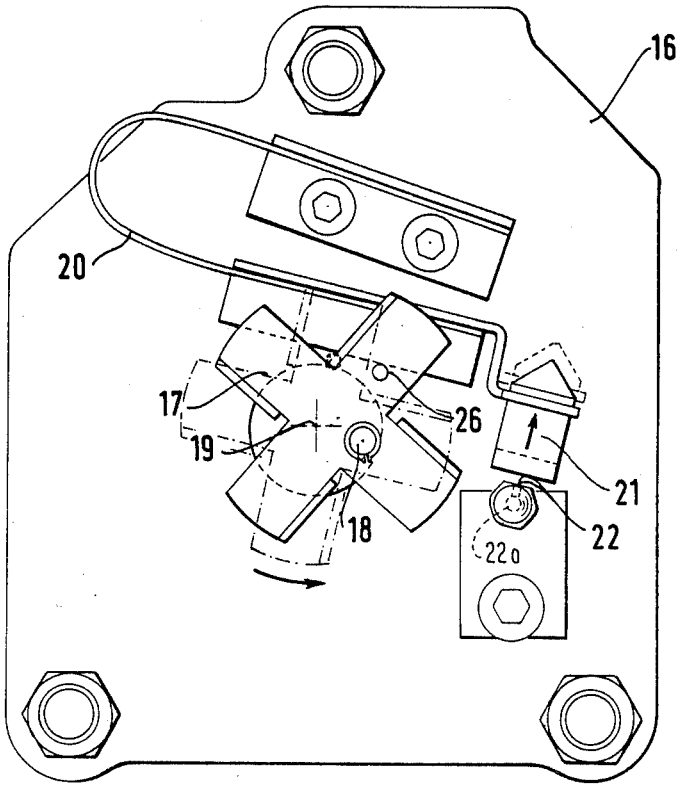
FIG. 2 PRIOR ART
FIG. 2 shows the oil inlet system in a side panel of the stator of the pump of FIG. 1.

The rotor is rotatively driven in the direction of arrow F by a motor (not shown) in the drawing, which is mounted to one of the stator's two side panels. The other side panel 16, shown schematically in FIG. 2, comprises the stator oil feed system. It is provided with a turnstile 17, attached to the rotor shaft at point 18, said attachment allowing the turnstile to rotate slightly about point 18. Point 18 is offset with respect to the center 19 of the turnstile. At rest, the center 19 of the turnstile coincides with the rotor axis. When rotating, the reaction of the oil on the turnstile, which includes a set of vanes, offsets the turnstile from the rotor axis. Said off-setting of the turnstile causes—through the action of a pin 26 fixed to turnstile 17, once per turn—a spring 20 to push up a cutoff valve 21 connected thereto, opening the stator oil supply inlet 22 to tank 6 and oil 7 leading through wall 16 to chamber 23. At rest, the turnstile, due to its weight and to the pressure of the spring, resumes its centered position; the spring is no longer pushed up and the cutoff valve 21 closes against supply inlet 22.

Clearly, if this injection system malfunctions such that, for example, the oil supply inlet 22 fails to close when the pump is at rest, oil 7 will enter the chamber 23 (FIG. 1), from tank 6 via inlet passage 22*a* and consequently be violently ejected through the discharge port 10 at the next starting of the pump. However, as the figure shows, the passageway 10 for the oil is small, especially since the vertical stroke of the check valve 11 is small. Indeed, the stroke must be kept to a minimum as it corresponds with a lack of guidance of the spring.

The spot facing 12 is necessary because it serves as an oil trap sealing the valve. The violent ejection and small clearance for the oil damage the valve and spring.

Figure 3:
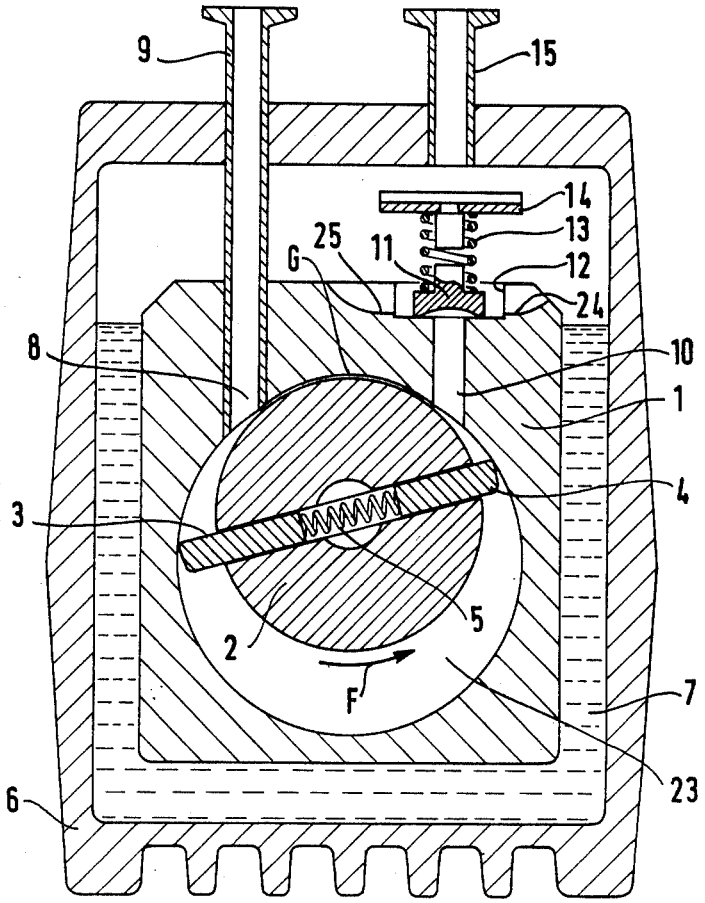
FIG. 3 is a sectional view, taken normally to the rotational axis, of a vane pump modified according to the invention.

In accordance with the invention, and referring to FIG. 3, a clearance slot 24 is provided in the stator 1 and opens into the recessed spot facing 12 at a level just slightly higher than the bottom of said spot facing such as to provide a small oil seal. Moreover, this slot 24 extends laterally beyond the diametrically opposite wall of the spot facing to an area designated by the reference 25. Obviously, as soon as valve 11 rises even slightly, this slot 24–25 affords a larger space for the ejected oil discharging off check valve 11 into the spot facing 12 and draining back to tank 6 via clearance slot 24, opening at the side of stator 1 to the interior of tank 6 so that the spring 13 and valve 11 operate under much more favorable conditions and are no longer prone to damage.

Figure 4:
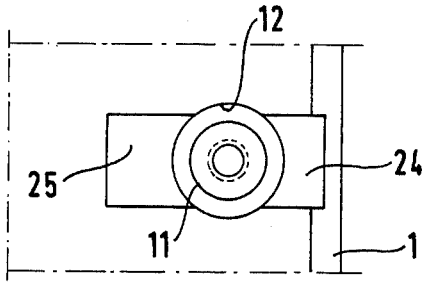
FIG. 4 is a top plan view of the discharge port of a vane pump according to the invention.

The clearance slot 24 is shown in top plan view in FIG. 4.

What we claim is:

1. In an oil-sealed vane pump with a stator and rotor both mounted in an oil-filled tank, said stator having an oil injection orifice opening to said tank below the oil level, therein, a suction port connected to a tank inlet pipe and a discharge port opening into said tank, said discharge port being provided with a check valve, said check valve comprising a spring biased valve element overlying said discharge port and fitted into a recessed spot facing in the stator, said tank further comprising a discharge port, the improvement wherein said pump is provided with at least one clearance slot in said stator, said clearance slot opening from the side of said stator into said recessed spot facing, and wherein said stator clearance slot opens to said recessed spot facing at a level just slightly higher than the bottom of said recessed spot facing, and wherein said check valve element is of a height in excess of the distance between the bottom of said spot facing and the level of said slot where it opens to said recessed spot facing such that said valve element is unsubmerged and a thin film of oil is maintained in the bottom of said recessed spot facing when said valve element is closed, whereby, said clearance slot significantly increases the area for receiving ejected oil discharging into said recessed spot facing off said check valve element for drainage back to said tank via said clearance slot opening to the side of said stator and to the interior of said tank.

2. A pump as claimed in claim 1, wherein said spot facing has diametrically opposed walls, and said stator clearance slot begins at the periphery of the stator, goes through the spot facing and extends beyond the diametrically opposite wall of the spot facing.

* * * * *